United States Patent [19]

Peel

[11] Patent Number: 4,460,246

[45] Date of Patent: Jul. 17, 1984

[54] EXTENSIBLE MIRROR WITH HIDDEN EXTENDING MECHANISM

[76] Inventor: David D. Peel, 11311 Ganesta Rd., San Diego, Calif. 92126

[21] Appl. No.: 375,063

[22] Filed: May 5, 1982

[51] Int. Cl.[3] ..... G02B 5/08; G02B 5/10; A47B 67/00; A47G 1/00

[52] U.S. Cl. ..... 350/305; 350/299; 312/225; 312/226

[58] Field of Search ..... 350/305, 288, 299; 312/224, 225, 226

[56] References Cited

U.S. PATENT DOCUMENTS

| | | | |
|---|---|---|---|
| 499,630 | 6/1893 | French et al. | 312/226 X |
| 915,913 | 3/1909 | Warren | 312/226 X |
| 1,705,320 | 3/1929 | Venegas | 350/305 |
| 2,145,462 | 1/1939 | Speck | 312/225 X |

FOREIGN PATENT DOCUMENTS

| | | | |
|---|---|---|---|
| 1283151 | 7/1972 | United Kingdom | 312/225 |

*Primary Examiner*—John K. Corbin
*Assistant Examiner*—Richard F. Gallivan
*Attorney, Agent, or Firm*—Ralph S. Branscomb

[57] ABSTRACT

An extending mirror which both swings out to space itself from its original position and also rotates about its mounting post has a crank mechanism which nests in a groove cut in the top of an upright panel which comprises one of the decorative members of a vanity, so that the mirror when in its home position does not reveal any of the extending mechanism, which comprises a double-ended crank, but when the mirror element is raised it can be swung rearwardly or forwardly on the crank to space it from other mirrors permanently mounted on the vanity so that the user may get side and rear views of his or her head.

9 Claims, 5 Drawing Figures

FIG.-1
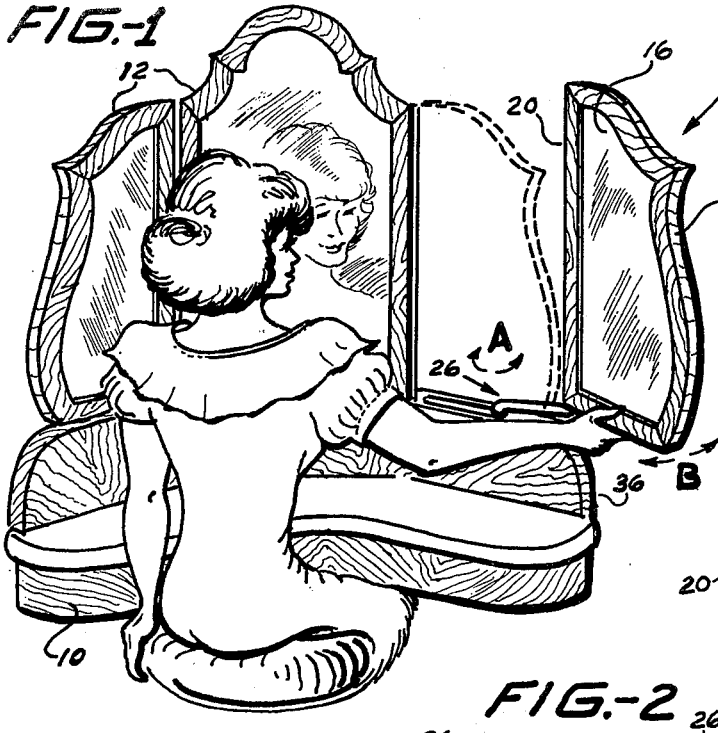
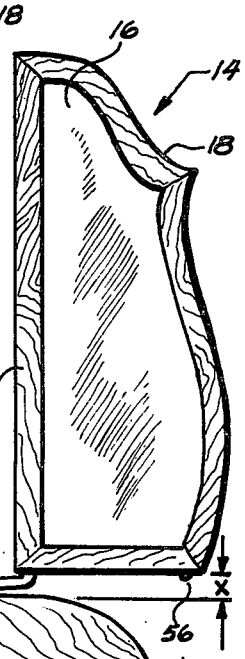
FIG.-2
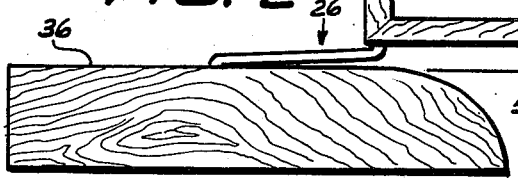
FIG.-3
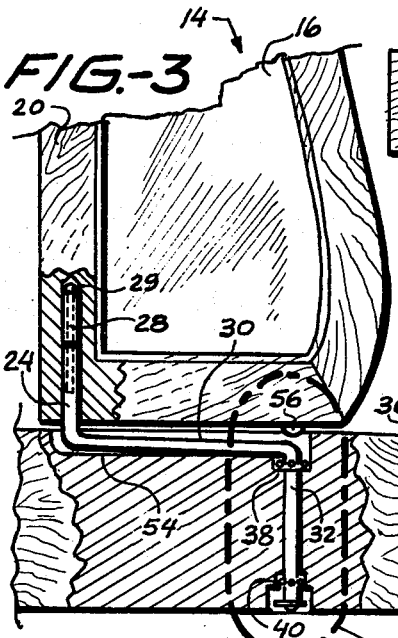
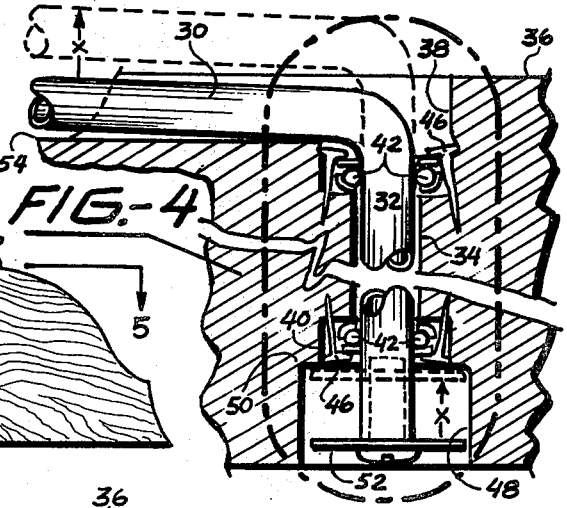
FIG.-4
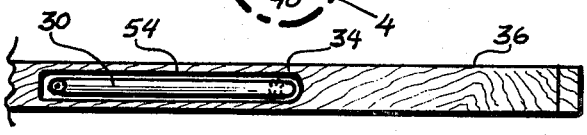
FIG.-5

EXTENSIBLE MIRROR WITH HIDDEN EXTENDING MECHANISM

BACKGROUND OF THE INVENTION

Most conventional vanities have one, two, or three mirrors, usually requiring the person using the vanity to use a hand mirror in order to see the sides and back of her head. Even the vanities that have pivotal mirrors on either side of a large central mirror still are incapable of providing the user with a view of the rear or rear side portions of the head, but merely provide a better view of the forward portions of the face and head, albeit from a side angle.

To be certain, vanities and other furniture pieces have been invented which mount mirrors which can swing into a position spaced from the permanently mounted mirror so that the head may be viewed from the rear and the rear side. However, ordinarily these are somewhat awkward looking mechanisms and no effort is made to hide the rather mechanical and non-aesthetic appearance of the apparatus. Examples of this type of system are shown in U.S. Pat. Nos. 915,913, 499,630, and 1,705,320.

Clearly most modern women would not appreciate a piece of furniture which was otherwise decorative and aesthetically pleasing but which had an unsightly gear or swing arm, or scissor arm which extended to space a mirror behind the existing mirror or mirrors. Therefore, there is a need for a mirror which not only will swing rearwardly of its initial position and be rotatable in its new position, but which also is mounted on a mechanism which is completely hidden when the mirror is in its normal position and which offers the least possible in the way of exposed mechanical mechanism when the mirror is swung rearwardly, so that women purchasing vanities will not be forced to choose between those which are most functional and those which are most aesthetically pleasing.

SUMMARY OF THE INVENTION

The instant invention exactly fulfills the above stated need by providing a mirror extension mechanism which would ordinarily be mounted to a vanity and which in its home position is completely hidden by virtue of the mirror element being mounted on a crank having a horizontal length, an upward post extending into a hollow socket in the mirror element, and at the other end of the horizontal length a depending shaft which pivots in a socket defined in one structural element of the vanity. When in its nested or home position, the otherwise exposed horizontal segment of the crank falls down into a groove cut for that purpose in the top of a support member, so that nothing is visible and there is no way of telling that the swinging mirror is not in fact a permanently mounted stationary mirror, which according to the embodiment illustrated symmetrically matches a mirror element on the opposite side of the principle mirror of the vanity.

When swung outwardly, however, the horizontal length pops outwardly slightly from the groove, and rides on the wood members alongside the groove into which the length seats, to permit the moving mirror element to swing widely out on the order of ten inches from its starting position.

BRIEF DESCRIPTION OF THE DRAWINGS

FIG. 1 is a front elevation view of the vanity illustrating a woman using it, with the moving mirror element illustrated in home position in phantom;

FIG. 2 illustrates the mirror element itself in extended position;

FIG. 3 illustrates the crank mechanism used to make the mirror element move with the wood surrounding same cut away to reveal the crank;

FIG. 4 is a detailed view of the shaft portion of the crank with the surrounding wood cut away;

FIG. 5 is top elevation view of the support member having the slot which houses the horizontal portion of the crank.

DETAILED DESCRIPTION OF THE PREFERRED EMBODIMENT

FIG. 1 illustrates a vanity 10 in use, showing the existing mirrors 12, the central mirror being the main mirror and the left mirror being angled slightly, and the moving mirror element 14 of the instant invention. When in the close-in position or seated position shown in FIG. 1 in phantom, the mirror element 14 matches the left of the mirrors 12, so that the unit appears to be a conventional vanity with a central main mirror and a pair of angled side mirrors.

The mirror element is composed of the reflective glass itself 16 and a frame 18. The frame has an inward upright length 12 which defines an upright socket 22 into its lower end. This socket smoothly receives the upright post 24 of crank 26, the upper end of which is a rotary bushing 28 press-fitted into the socket 22, which is held into the post 24 with a screw 29.

The crank also has a substantially horizontal length 30 which at the opposite end from the upright post bends down into a depending shaft 32. This shaft is seated in a socket 34 bored through the support member 36, which represents one of the both decorative and functional pieces of the vanity.

This socket is counterbored at the top at 38 and also at 40 at the bottom to receive bearing cages 42 with their annular caps 44, with the caps being on the outermost side of the bearings. These bearings are secured in place in a very simple manner by nails 46, or their equivalent. An additional, larger counterbore at 48 beneath the lower counterbore 40 defines a shoulder 50 which engages a washer detent 52 mounted at the lower end of the shaft.

The support member 36 also has an elongated slot 54 milled into its top to seat the horizontal length 30 of the crank. When so seated as shown in FIG. 3, the crank is for all intents and purposes totally concealed. There may also be a detent button 56, shown in FIG. 2, to secure the outer end of the mirror element in the right position.

When in the deployed position, the mirror element swings out on its crank as shown in FIGS. 1 and 2. Before it is able to swing, it will be noted from FIG. 4 that there is sufficient play in the vertical movement permitted of the depending shaft 32 to permit the horizontal portion to clear its slot as shown in FIG. 4 is phantom, and that this raising must be done prior to swinging the mirror out.

Because the horizontal length 30 of the crank is angled slightly from its shaft to its upright post as can be seen in FIGS. 2 and 3, only the portions of the top of the support 36 which are adjacent the seating slot are actually bearing against this horizontal length. The bearings 42 in the socket 34, it should be noted, only support the crank against side thrusts and provides no support vertically. This support is provided in the seated position by the horizontal length of the crank resting in the slot 54, and in the outward position by the same length resting on various portions of the top of the support member 36 as the crank swings out.

Although of course this mechanism could be used in any swinging mirror mechanism, that illustrated is a good example of a vanity which, if used with a double-action mirror such as the instant invention provides, enables the user through multiple mirrors to obtain multiple views of any side of her head or face that she desires. However, clearly the invention is broader than the vanity shown per se, and has applications in furniture pieces of many different designs.

While the preferred embodiment of the invention has been described, other modifications may be made thereto and other embodiments may be devised within the spirit of the invention and scope of the appended claims.

What is claimed is:

1. An extensible mirror with a hidden support mechanism comprising:

(a) a stationary support member;

(b) a framed mirror element;

(c) a crank rod defining an upright mounting post, a generally horizontal length extending from the lower end of said post, and a depending vertical shaft at the end of said horizontal length opposite the end of said post;

(d) said framed mirror having a mirror socket receiving in journalled relation said post;

(e) a support socket defined in said support member for receiving said shaft in journalled relation, whereby said mirror can be swung from a seated positon to a deployed position out on said crank to be variably positioned thereon and variably oriented on said mounting post; and, (f) said shaft being allowed limited axial play in said support socket and said support defining an elongated frontal barrier behind which said horizontal length rests when said mirror is in its seated position with said shaft at the lowest extent of its allowed play.

2. Structure according to claim 1 wherein said support member defines an elongated substantially horizontal groove, the portion defining the forward surface of same comprising said frontal barrier, whereby in said seated position said horizontal length seats in said groove.

3. Structure according to claim 2 wherein said mirror is part of a piece of furniture having a second mirror adjacent said first-mentioned mirror, and when the latter is in seated position said mirror socket is defined in the portion of said first-mentioned mirror adjacent said second mirror, and said support socket is remote therefrom, whereby said first-mentioned mirror can swing a substantial distance from said second mirror and pivot on said post to be used in conjunction with said second mirror to define a compound mirror system.

4. Structure according to claim 2 wherein said mirror socket is defined in one end of the bottom portion of said mirror element and spaced toward the other end therefrom is a detent nib to seat in cooperative structure in said support in the seated position.

5. Structure according to claim 2 wherein said support socket rotationally supports said shaft only against lateral thrusts, and vertical support for said mirror element when swinging from seated to deployed position is provided by said horizontal length sliding over said frontal barrier.

6. Structure according to claim 5 wherein said substantially horizontal length actually slopes upward slightly from the shaft end to the post end so that same only slides on the edge of said barrier adjacent said slot when said mirror element is deployed between said seated and said deployed position.

7. Structure according to claim 1 wherein said mirror socket defines a deep bore dimensioned to seat said post, and said post defines a coaxially journalled bushing press-fitted into said bore.

8. Structure according to claim 1 wherein said support socket includes a pair of spaced, capped bearings engaging said shaft and said shaft has a retainer at its lower end limiting the upward motion of said shaft.

9. Structure according to claim 8 wherein said support member is an upright wooden member and said support socket is counterbored at the top and bottom thereof to receive said capped bearings and the lower end of said support socket is doubly counterbored to define a stop shoulder for said retainer.

* * * * *